US005879126A

United States Patent [19]

Kim

[11] Patent Number: 5,879,126

[45] Date of Patent: Mar. 9, 1999

[54] WORKING UNIT OF CONTRUCTION EQUIPMENT WITH ATTACHMENT SELF LEVELING FUNCTION

[75] Inventor: Kee Young Kim, Anyang, Rep. of Korea

[73] Assignee: Samsung Heavy Industries Co., Ltd., Seoul, Rep. of Korea

[21] Appl. No.: 971,482

[22] Filed: Nov. 15, 1997

Related U.S. Application Data

[62] Division of Ser. No. 565,264, Nov. 30, 1995, Pat. No. 5,688,101.

[30] Foreign Application Priority Data

Apr. 29, 1995 [KR] Rep. of Korea ..... 1995-10519
Apr. 29, 1995 [KR] Rep. of Korea ..... 1995-10520

[51] Int. Cl.[6] ..... E02F 3/34

[52] U.S. Cl. ..... 414/713; 414/706

[58] Field of Search ..... 414/700–715, 414/697, 680; 74/105

[56] References Cited

U.S. PATENT DOCUMENTS 2,807,379 9/1957 Pilch ..... 414/713 X
2,885,103 5/1959 Cunningham, Jr. .
2,989,199 6/1961 Hough et al. .
3,133,653 5/1964 Anderson .
3,155,253 11/1964 Pilch ..... 414/715 X
3,529,740 9/1970 Chant ..... 414/715 X
4,364,705 12/1982 Shumaker ..... 414/713
4,844,685 7/1989 Sagaser .

FOREIGN PATENT DOCUMENTS 622676 1/1959 Italy ..... 414/714

*Primary Examiner*—Donald W. Underwood
*Attorney, Agent, or Firm*—Kenyon & Kenyon

[57] ABSTRACT

A working unit of construction equipment with an attachment self leveling function is disclosed. The working unit includes an attachment self leveling linkage. The linkage automatically maintains the desired angle of the attachment relative to the reference or ground surface, thereby maintaining the horizontal position of the attachment without any motion for controlling the bucket cylinder while lifting up the attachment from the initial position to the uppermost position by the arm-up motion during the operations of construction equipment. The attachment self leveling linkage has a simplified construction, thereby being easily produced and installed at a lower cost and lightening the weight of the working unit. The linkage thus improves the operational efficiency of the working unit.

5 Claims, 8 Drawing Sheets

WORKING UNIT OF CONTRUCTION EQUIPMENT WITH ATTACHMENT SELF LEVELING FUNCTION

This application is a divisional application of Ser. No. 08/565,264 filed on Nov. 30, 1995, now U.S. Pat. No. 5,688,101.

BACKGROUND OF THE INVENTION

1. Field of the Invention

The present invention relates in general to a working unit of construction equipment such as excavators and loaders. More particularly, the invention relates to a structural improvement in an attachment self leveling linkage suitable to automatically maintain the desired angle of the attachment, such as a bucket or fork detachably mounted to the tip of the working unit, relative to the reference or ground surface, thereby maintaining the horizontal position of the attachment without any motions for controlling the bucket cylinder while lifting the attachment from the initial ground position to its uppermost position by the arm-up motion during the operations of construction equipment.

2. Description of the Prior Art

In typical construction equipment such as loaders, various types of attachments are detachably mounted to the tip of the working unit, thereby effectively performing the desired operations such as digging, loading and lifting operations. The above attachments are selectively pivoted to the tip of the arm which is included in the working unit. The above arm is pivoted to the forehead of the construction equipment's frame. A hydraulic cylinder (hereinbelow, referred to as "arm cylinder") is pivoted to the frame of the construction equipment at its cylinder part and pivoted to the middle portion of the arm at its actuating rod part. Due to the telescopic motion of the actuating rod of the above arm cylinder, the arm can be turned up or down about the pivot joint between the arm and the frame's forehead. In addition, another hydraulic cylinder (hereinbelow, referred to as "bucket cylinder") is pivoted to the arm at its cylinder part and pivoted to the attachment or bucket at its actuating rod part. Due to the telescopic motion of the actuating rod of the above bucket cylinder, the attachment can be turned in and out about the pivot joint between the arm and the attachment, thereby performing the desired operations.

However, the angle of the attachment relative to the reference or ground surface cannot be maintained at a fixed angle while turning up or down the arm by simply operating the arm cylinder without operating the attachment by handling, for example, the bucket control lever. That is, the angle of the attachment relative to the ground surface in the above case gradually varies in accordance with the positional displacement of the arm, thereby failing to maintain the horizontal position of the attachment while turning the arm up or down. Therefore, the operator during the operations performed by a fork used as the attachment must handle the bucket control lever continuously so as to adjust the angle of the fork and to maintain the horizontal position of the fork while turning the arm up or down. This is inconvenient to the operator and reduces the operational efficiency of the construction equipment. That is, the operator must handle the bucket control lever to continuously adjust the angle of the attachment relative to the ground surface simultaneously while handling the arm control lever so as to turn the arm up or down. Such a lever handling motion not only requests the operator to be highly skilled, it also remarkably reduces the operational efficiency of the construction equipment.

In an effort to rectify the above problems, attachment self leveling linkages have been actively studied and developed in the field of the art. The above attachment self leveling linkages are used for automatically maintaining the desired angle of the attachment relative to the ground surface without needing to handle the bucket control lever while lifting up the attachment from the initial ground position, for example, the initial digging or loading position, to the uppermost position during the operations of construction equipment.

Construction equipment with the above attachment self leveling linkage has built up large markets particularly in the Americas. The origin of attachment self leveling linkages for construction equipment goes back to the linkage disclosed in U.S. Pat. No. 2,817,448. However, the attachment self leveling linkage disclosed in the above U.S. patent has a complicated construction as it includes a plurality of connection members with the pivot joints in the same manner as most of the early attachment self leveling mechanisms which were proposed in the 1950's but have not been used practically. Therefore, the attachment self leveling linkage of the above U.S. patent has problems that the linkage is very difficult to produce, increases the cost and weight of the working unit and has a poor operational efficiency.

In addition, other types of attachment self leveling mechanisms using hydraulic circuits instead of the above linkages for maintaining the horizontal position of the attachment have been proposed and used practically. The above self leveling mechanisms using hydraulic circuits perform the same functions as those of the above-mentioned attachment self leveling linkages. However, the operational reliability of the above self leveling mechanisms using the hydraulic circuits are lower than that of the attachment self leveling linkages. In this regard, the self leveling linkages have been used more preferably to the self leveling mechanisms with the hydraulic circuits. In the field of the art, it thus needs to simplify the construction of the attachment self leveling linkages while achieving the desired operational effect of the linkages. When the construction of the attachment self leveling linkages is simplified as described above, the linkages can be easily produced at the lower cost. The self leveling linkages with the simplified constructions also reduce the weight of the working units of the construction equipment, thereby improving the operational efficiency of the equipment.

Representative examples of the attachment self leveling linkages with the simplified construction suitable to achieve the above object are disclosed in U.S. Pat. Nos. 4,486,141 and 5,201,235.

In order to improve the construction of the linkage of U.S. Pat. No. 2,817,448, the attachment self leveling linkage disclosed in U.S. Pat. No. 4,486,141 includes a shorter arm cylinder achieving the same operational effect. However, the self leveling linkage of U.S. Pat. No. 4,486,141 has a problem in that a plurality of link members are concentrated to around the equalizer bar thereby applying overload onto the equalizer bar during the operations of the construction equipment. In addition, the shorter arm cylinder must be pivoted to a lower portion of the equipment's frame. Therefore, the arm cylinder's length is not sufficiently reduced because the arm cylinder should turn the arm up to the desired uppermost position during the operation of the equipment.

Meanwhile, the construction of the attachment self leveling linkage of U.S. Pat. No. 5,201,235 is schematically shown in the accompanying drawing, FIG. 1. As shown in FIG. 1, the above linkage somewhat reduces the number of links and pivot joints between the links. However, both the arm cylinder 302 and the equalizer bar 303 pivoted to both ends of a relatively longer equalizer lever 301 need to be lengthened so as to adjust the attachment within the total operating range. In addition, the longer equalizer lever 301 somewhat projects out of the lower side of the arm 304. The lever 301 thus may strike an obstacle, such as a truck deck, placed ahead of the lever 301 during the operations of construction equipment.

SUMMARY OF THE INVENTION

It is, therefore, an object of the present invention to provide a working unit of construction equipment with an attachment self leveling function in which the above problems can be overcome and which automatically maintains the desired angle of the attachment relative to the reference or ground surface, thereby maintaining the horizontal position of the attachment without any motions for controlling the bucket cylinder while lifting up the attachment from the initial position to the uppermost position by the arm-up motion during the operations of construction equipment.

It is another object of the present invention to provide an attachment self leveling linkage having a simplified construction which is easily produced and installed at lower cost and lightens the weight of the working unit, thereby improving the operational efficiency of the working unit.

In order to achieve the above objects, an embodiment of the present invention provides a working unit of construction equipment comprising an arm pivoted to an equipment's frame and an attachment pivoted to the arm, further comprising an attachment self leveling linkage including: a first telescopic means pivoted to the frame at one end thereof and pivoted to a predetermined portion of the arm at the other end thereof; a first link pivoted to the frame at one end thereof; a second telescopic means pivoted to the other end of the first link at one end thereof and pivoted to the attachment at the other end thereof; and a second link pivoted, at one end thereof, to one pivot joint between the other end of the first link and the one end of the second telescopic means and pivoted, at the other end thereof, to another pivot joint between the other end of the first telescopic means and the predetermined portion of the arm, thereby shifting the one end of the second telescopic means in accordance with a telescopic motion of the first telescopic means and allowing the attachment to maintain its initial angle relative to a reference surface during an arm-up or down motion.

In accordance with another embodiment of the invention, the attachment self leveling linkage includes: a first telescopic means pivoted to the frame at one end thereof and pivoted to a predetermined portion of the arm at the other end thereof; a first link pivoted to a pivot joint between the frame and the first telescopic means at one end thereof; a second link pivoted, at one end thereof, to the other end of the first link and pivoted, at the center thereof, to a predetermined portion of the arm together with the other end of the first telescopic means; and a second telescopic means pivoted to the other end of the second link at one end thereof and pivoted to the attachment at the other end thereof, thereby allowing the attachment to maintain its initial angle relative to a reference surface in accordance with a telescopic motion of the first telescopic means.

In accordance with a further embodiment, the attachment self leveling linkage includes: a first telescopic means pivoted to the frame at one end thereof and pivoted to a predetermined portion of the arm at the other end thereof; a first link pivoted to another predetermined portion of the arm at one end thereof; a second telescopic means pivoted to the frame at one end thereof and pivoted to the other end of the first link; and a second link pivoted to the attachment at one end thereof and pivoted, at the other end thereof, to a pivot joint between the other end of the second telescopic means and the first link, the one end of the second link being shifted by the first link in accordance with a telescopic motion of the first telescopic means and allowing the attachment to maintain its initial angle relative to a reference surface during an arm-up or down motion.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
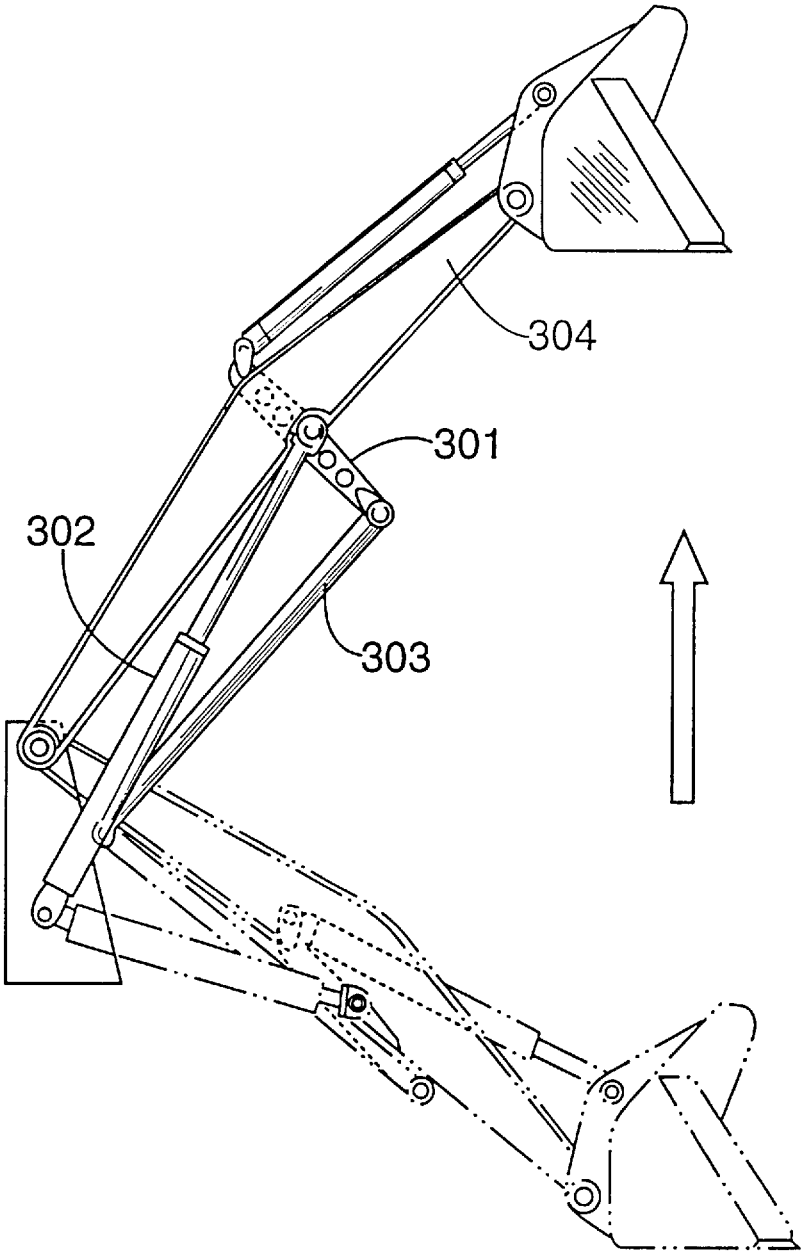
FIG. 1 PRIOR ART
FIG. 1 is a view showing the construction of the working unit of construction equipment with a typical attachment self leveling linkage.
Figure 2:
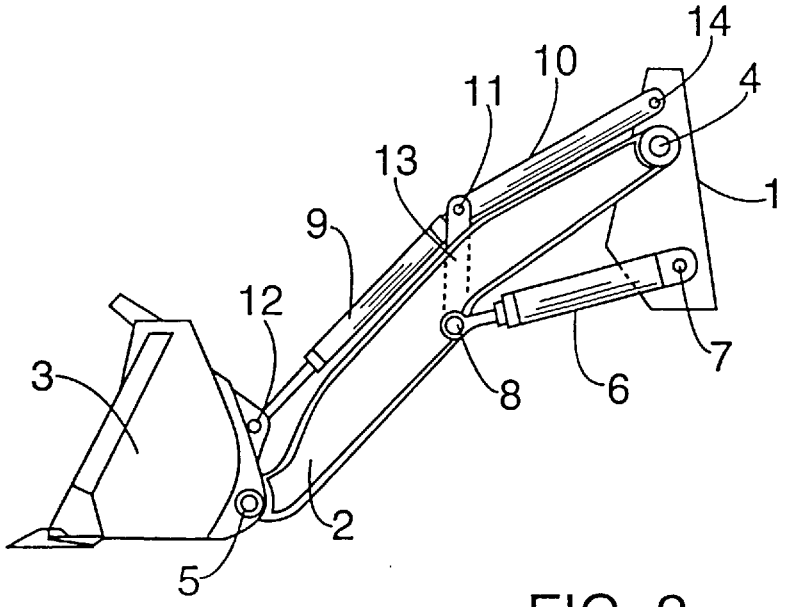
FIG. 2 is a view showing the construction of the working unit of construction equipment with an attachment self leveling linkage in accordance with an embodiment of the present invention.

FIG. 2 is a view showing the construction of the working unit of construction equipment with an attachment self leveling linkage in accordance with a primary embodiment of the present invention.

As shown in FIG. 2, the arm 2 is pivoted to the forehead of the equipment's frame 1 by a pivot joint. The arm 2 is thus turned up or down relative to the equipment's frame. Pivoted to the tip of the above arm 2 by a pivot joint is an attachment, for example, a bucket 3. The bucket 3 is turned in or out relative to the arm 2. The pivot pins provided in the above pivot joints are designated by the reference numerals 4 and 5, respectively. The working unit with the attachment self leveling function of this invention also includes two actuators of the cylinder type, that is, an arm cylinder 6 and a bucket cylinder 9. The arm cylinder 6 or the first telescopic unit used for turning up or down the arm 2 relative to the frame 1 is pivoted to the frame 1 by a pivot pin 7 at one end thereof. The other end of the arm cylinder 6 is pivoted to a predetermined portion of the arm 2 by a pivot pin 8. Meanwhile, the bucket cylinder 9 or the second telescopic unit is used for turning in or out the bucket 3 relative to the arm 2. One end of the above bucket cylinder 9 is pivoted to one end of a first link 10 by a pivot pin 11. The other end of the above first link 10 is pivoted to the frame 1 by a pivot pin 14. The other end of the above bucket cylinder 9 is pivoted to the bucket 3 by a pivot pin 12. The working unit of this invention also includes a second link 13. One end of the second link 13 is pivoted to the other end of the arm cylinder 6 by the pivot pin 8, while the other end of the link 13 is pivoted to the bucket cylinder 9 and to the first link 10 by the pivot pin 11.

Figure 3:
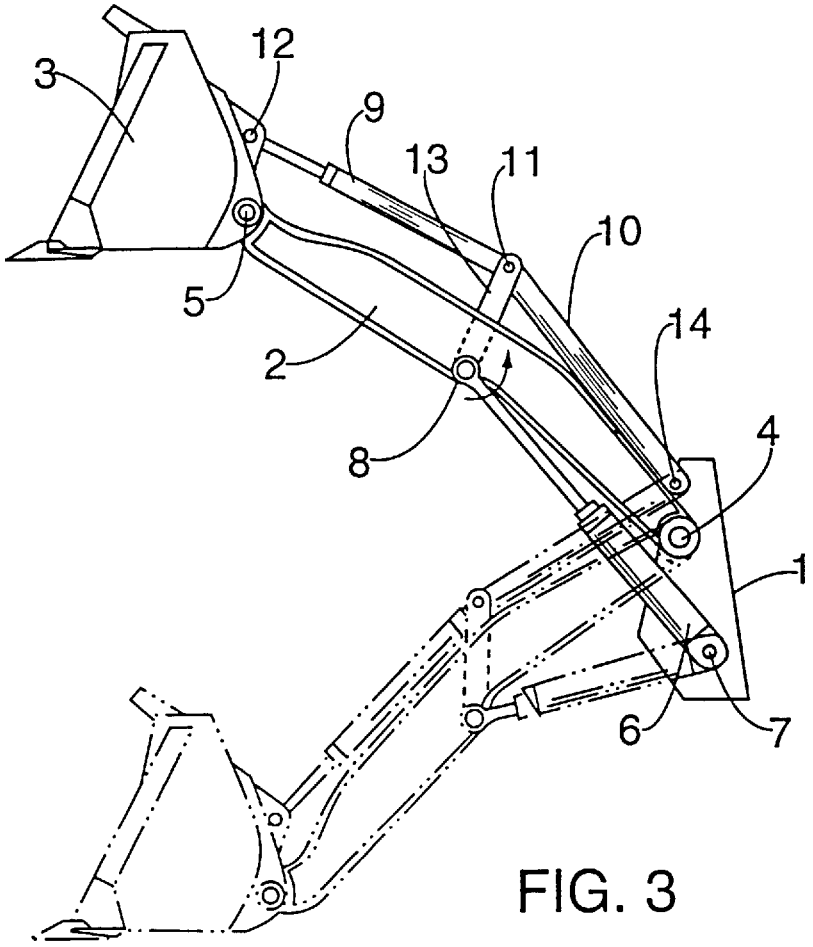
FIG. 3 is a view showing the motions of the working unit of FIG. 2 during the operation of construction equipment.

The operational effect of the above working unit with the attachment self leveling function of the primary embodiment will be described hereinbelow with reference to FIG. 3.

When the arm cylinder 6 is applied with pressurized oil outputted from an oil pump thereby being extended, the arm 2 is turned up about the pivot pin 4 so as to lift up the bucket 3 in proportion to the extended length of the arm cylinder 6. In the above state, the second link 13 which is pivoted to the other end of the arm cylinder 6 by the pivot pin 8 is turned about the pivot pin 8 counterclockwise. As a result of the counterclockwise turning motion of the link 13, the angular position of the pivot pin 11, to which the other end of the link 13 is pivoted, is shifted counterclockwise thereby becoming more distant from the frame 1. Such a movement of the pivot pin 11 causes the one end of the bucket cylinder 9 to be pushed leftward in the drawing, thereby turning the bucket 3 counterclockwise about the pivot pin 5. The absolute angle of the bucket 3 about the pivot pin 5 is thus automatically controlled, so that the bucket 3 automatically maintains its horizontal position relative to the reference or ground surface during the arm-up motion. Of course, it should be understood that the angle of the bucket 3 relative to the arm 2 also may be manually controlled by the operator by handling the bucket control lever to apply pressurized oil to the bucket cylinder regardless of the above-mentioned self leveling function.

Figure 4:
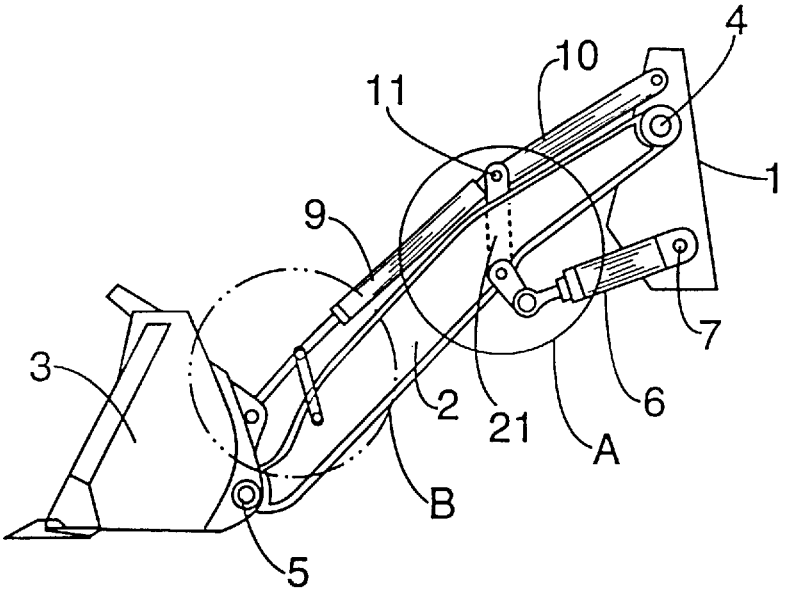
FIG. 4 is a view showing the construction of the working unit of construction equipment with a attachment self leveling linkage in accordance with another embodiment of the present invention.
Figure 5:
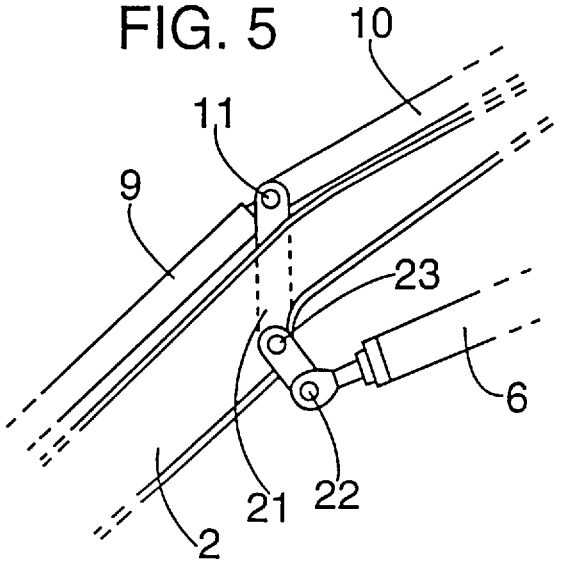
FIG. 5 is a partially enlarged view showing the construction of the circled portion of the working unit of FIG. 4.

The construction of the working unit according to the above primary embodiment may be preferably altered as shown in FIGS. 4 and 5. In the above altered embodiment, the one end of the arm cylinder 6 is pivoted to the frame 1 by the pivot pin 7, while the other end of the arm cylinder 6 is not pivoted to the predetermined portion of the arm 2, but pivoted to one end of a second link 21 by a pivot pin 22 differently from the primary embodiment. The other end of the second link 21 is pivoted to the other end of the first link 10 and to the one end of the bucket cylinder 9 by the pivot pin 11. The middle portion of the second link 21 is pivoted to a predetermined portion of the arm 2 by the pivot pin 23.

In the operation of the working unit of the above altered embodiment, the arm cylinder 6 is applied with pressurized oil outputted from the oil pump thereby being extended to turn up the arm 2. In the above case, the second link 21 pivoted to the other end of the arm cylinder 6 by the pivot pin 22 is turned counterclockwise about the pivot pin 23 in proportion to the extended length of the arm cylinder 6, thereby approaching the frame 1. As a result of the counterclockwise turning motion of the link 21, the angular position of the pivot pin 11, to which the other end of the link 21 is pivoted, is shifted counterclockwise thereby becoming more distant from the frame 1. Such a movement of the pivot pin 11 causes the one end of the bucket cylinder 9 to be pushed leftward in the drawing, thereby turning the bucket 3 counterclockwise about the pivot pin 5. The absolute angle of the bucket 3 about the pivot pin 5 is thus automatically controlled, so that the bucket 3 automatically maintains its horizontal position relative to the reference or ground surface during the arm-up motion.

In the working unit of the above altered embodiment, it is more preferable to bend the second link 21 at the pivot point, at which the link 21 is pivoted to the arm 2 by the pivot pin 23, such that the one end portion of the link 21 is bent toward the frame 1 at a predetermined bending angle. In this case, the length of the arm cylinder 6 is further reduced.

Figure 6:
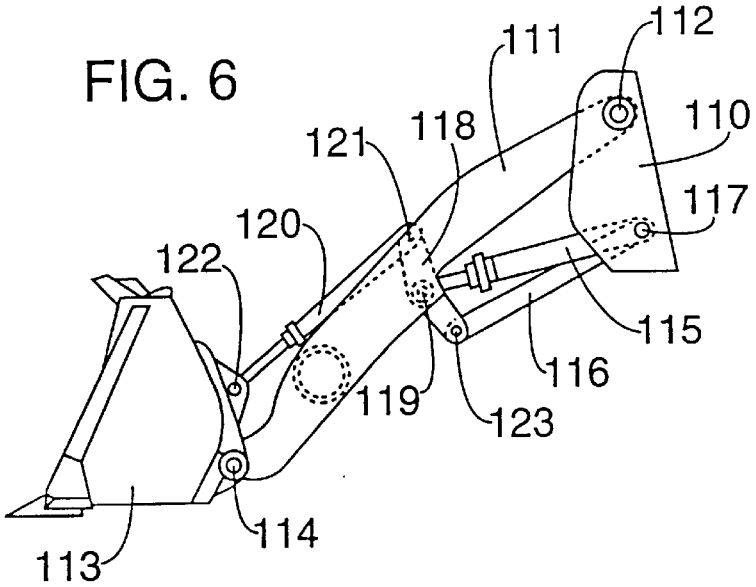
FIG. 6 is a view showing the construction of the working unit of construction equipment with an attachment self leveling linkage in accordance with a further embodiment of the present invention.

FIG. 6 is a view showing the construction of the working unit of construction equipment with an attachment self leveling linkage in accordance with a third embodiment of the present invention.

In the working unit of the third embodiment, one end of the arm 111 is pivoted to the frame 110 of the equipment by a pivot pin 112 such that the arm 111 is turned up or down about the pivot pin 112. The rear portion of the bucket 113 or the attachment is pivoted to the other end of the arm 111 by a pivot pin 114 such that the bucket 113 is turned in or out about the pivot pin 114.

Commonly pivoted to a portion of the frame 110 by a pivot pin 117 are one end of the arm cylinder 115 (first telescopic unit for operating the arm 111 relative to the frame 110) and one end of a first link 116. A second link 118 is pivoted to a predetermined portion of the arm 111 by a pivot pin 219. The pivot pin 119 also pivots the other end of the arm cylinder 115 to the second link 118. Meanwhile, the other end of the first link 116 is pivoted to one end of the second link 118 by a pivot pin 123. The bucket cylinder 120 (second telescopic unit for operating the bucket 113 relative to the arm 111) is pivoted to the other end of the second link 118 by a pivot pin 121 at one end thereof. The second link 118 is pivoted to the predetermined portion of the arm 111 by the pivot pin 119 as described above. Meanwhile, the other end of the bucket cylinder 120 is pivoted to the bucket 113 by a pivot pin 122.

The operational effect of the working unit of the second embodiment will be described hereinbelow with reference to FIG. 7.

Figure 7:
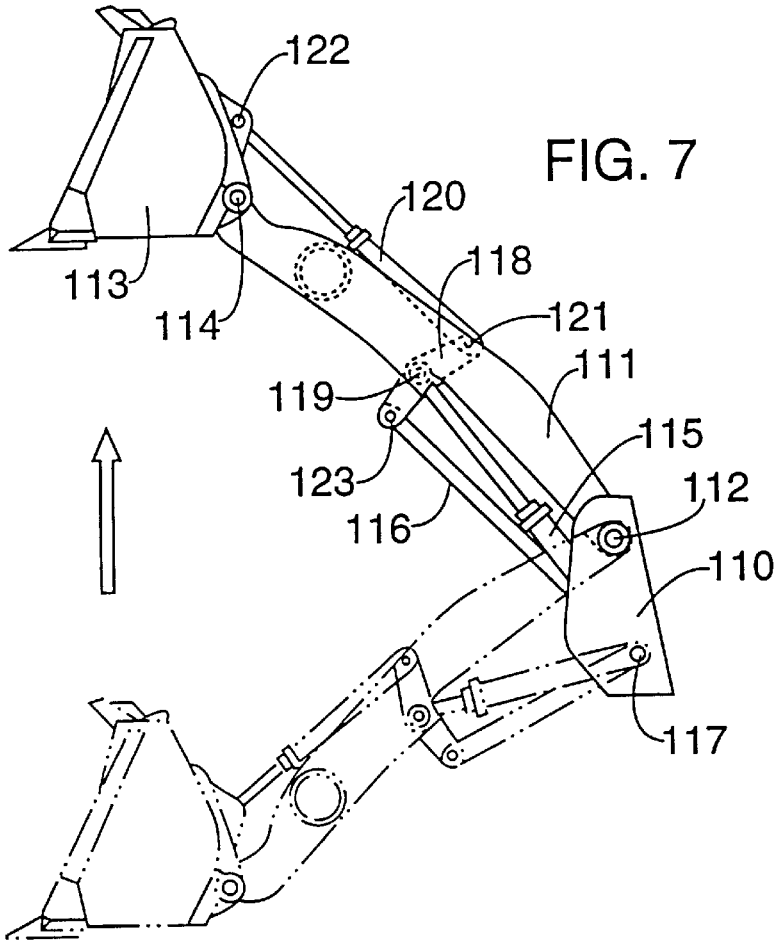
FIG. 7 is a view showing the motions of the working unit of FIG. 6 during the operation of construction equipment.

FIG. 7 shows the motions of the above working unit during the operation of the construction equipment. In order to turn up the arm 111 relative to the frame 110, the arm cylinder 115 is applied with pressurized oil from the oil pump, thereby being extended. When the arm cylinder 115 is extended as described above, the arm 111 is turned up relative to the frame 110 about the pivot pin 112 in proportion to the extended length of the arm cylinder 115. That is, the arm 111 is turned about the pivot pin 112 clockwise in FIG. 7. When the arm 111 is turned up as described above, the absolute distance between the pivot pins 117 and 119 is lengthened. The pin 117 pivots the arm cylinder 115 to the frame 110, while the pin 119 pivots the arm cylinder 115 to the predetermined portion of the arm 111. Due to the lengthened absolute distance between the pins 117 and 119, the first link 116 having a fixed length pulls the one end of the second link 118, pivoted to the arm 111, during the arm-up motion. Hence, the second link 118 is turned counterclockwise about the pivot pin 119, thereby pushing the bucket cylinder 120. The above pin 119 pivots the second link 118 to the arm 111.

The bucket 113 pivoted to the other end of the cylinder 120 is thus turned counterclockwise about the pivot pin 114, thereby changing its absolute angle. In this regard, the bucket 113 automatically maintains its horizontal position relative to the reference or ground surface during the arm-up motion.

Of course, it will be understood that the angle of the bucket 113 relative to the arm 111 also may be manually controlled by the operator by handling the bucket control lever to apply pressurized oil to the bucket cylinder 120 regardless of the above-mentioned self leveling function.

Figure 8:
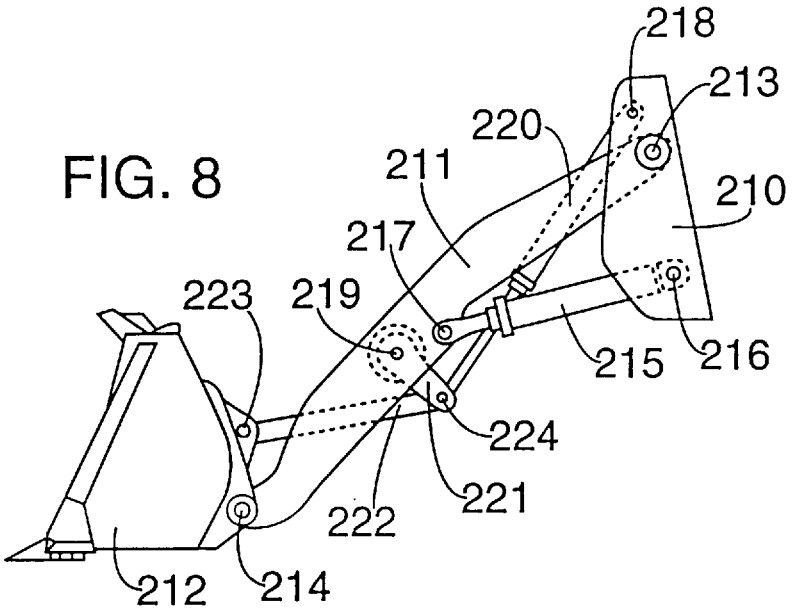
FIG. 8 is a view showing the construction of the working unit of construction equipment with an attachment self leveling linkage in accordance with a yet another embodiment of the present invention.

FIG. 8 is a view showing the construction of the working unit of construction equipment with an attachment self leveling linkage in accordance with a fourth embodiment of the present invention.

In the fourth embodiment of FIG. 8, one end of the arm 211 is pivoted to the frame 210 of the equipment by a pivot pin 213 such that the arm 211 is turned up or down about the pivot pin 213. The bucket 212 or the attachment is pivoted to the other end of the arm 211 by a pivot pin 214 such that the bucket 212 is turned in or out about the pivot pin 214.

One end of the arm cylinder 215 (first telescopic unit for operating the arm 211 relative to the frame 210) is pivoted to the frame 210 by a pivot pin 216. The other end of the arm cylinder 215 is pivoted to a predetermined portion of the arm 211 by a pivot pin 217.

A first link 221 is pivoted to a predetermined portion of the arm 211 by a pivot pin 219 at one end thereof. The working unit of the third embodiment also includes a second telescopic unit 220. One end of the above unit 220 is pivoted to the frame 210 by a pivot pin 218, while the other end of the unit 220 is pivoted to the other end of the above first link 221 by a pivot pin 224.

The bucket 212 is operated by a second link 222 whose one end is pivoted to the bucket 212 by a pivot pin 223. The other end of the second telescopic unit 220, pivotally extending from the frame 210, is pivoted to the other end of the first link 221, pivotally extending from the arm 211, by the pivot pin 224. The other end of the second link 222 is pivoted to the pivot joint between the unit 220 and link 221 by the pivot pin 224.

The operational effect of the working unit of the third embodiment will be described hereinbelow with reference to FIG. 9.

Figure 9:
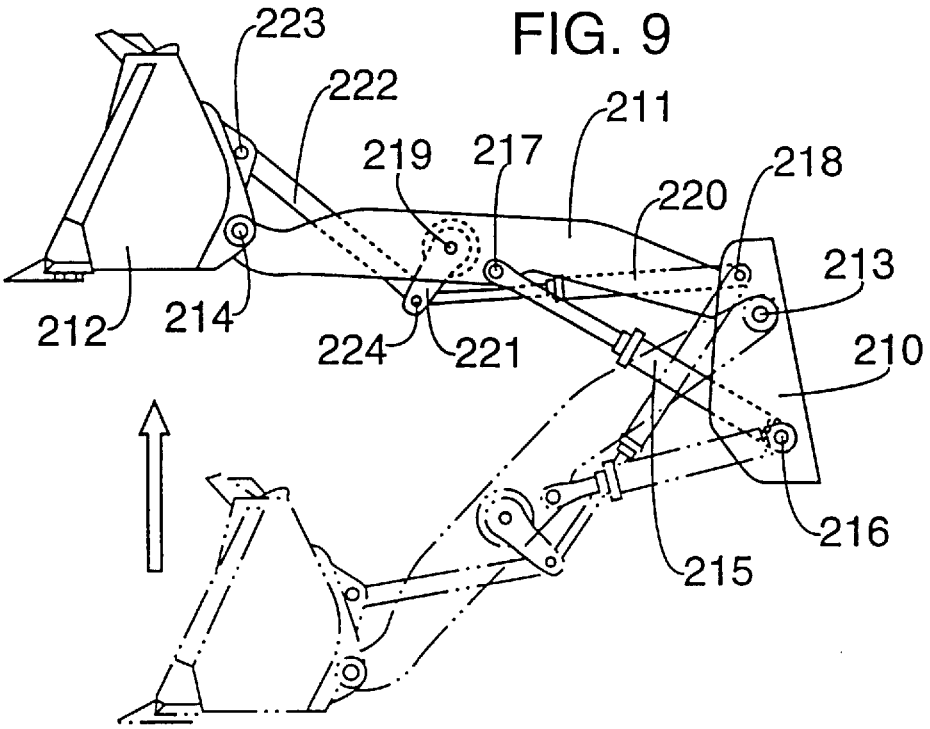
FIG. 9 is a view showing the motions of the working unit of FIG. 8 during the operation of construction equipment.

FIG. 9 shows the motions of the above working unit during the operation of the construction equipment. In order to turn up the arm 211 relative to the frame 210, the arm cylinder 215 is applied with pressurized oil from the oil pump, thereby being extended. When the arm cylinder 215 is extended as described above, the arm 211 is turned up relative to the frame 210 about the pivot pin 213 in proportion to the extended length of the arm cylinder 215. That is, the arm 211 is turned about the pivot pin 213 clockwise in FIG. 9. When the arm 211 is turned up as described above, the absolute distance between the pivot pins 218 and 224 is shortened due to the arm-up motion. The pin 218 pivots the one end of the second telescopic unit 220 to the frame 210, while the pin 224 pivots the other end of the second telescopic unit 220 to both the first and second links 221 and 222. However, there is no change in the stroke of the second telescopic unit 220 during the arm-up motion. In this regard, the pivot pin 224 is pushed and thereby moves clockwise about the pivot pin 219 during the arm-up motion. The above pivot pin 224 forms the pivot joint between the first and second links 221 and 222, while the pivot pin 219 forms the pivot joint between the first link 221 and the arm 211. As the position of the pivot pin 224 is displaced clockwise as described above, the bucket 212 which has been turned clockwise due to the arm-up motion is turned counterclockwise about the pivot pin 214 which forms the pivot joint between the arm 211 and the bucket 212. The bucket 212 thus maintains its initial angle relative to the reference or ground surface during the arm-up motion.

Of course, it will be understood that the angle of the bucket 212 relative to the arm 211 also may be manually controlled by the operator by handling the bucket control lever to apply pressurized oil to the bucket cylinder 120 regardless of the above-mentioned self leveling function.

Figure 10:
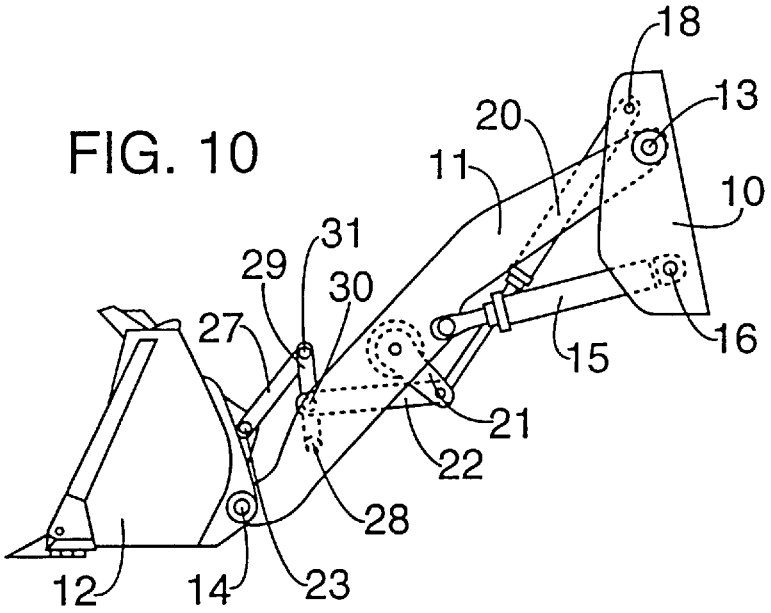
FIG. 10 is a view showing the construction of the working unit of construction equipment with an attachment self leveling linkage in accordance with a still another embodiment of the present invention.
Figure 11:
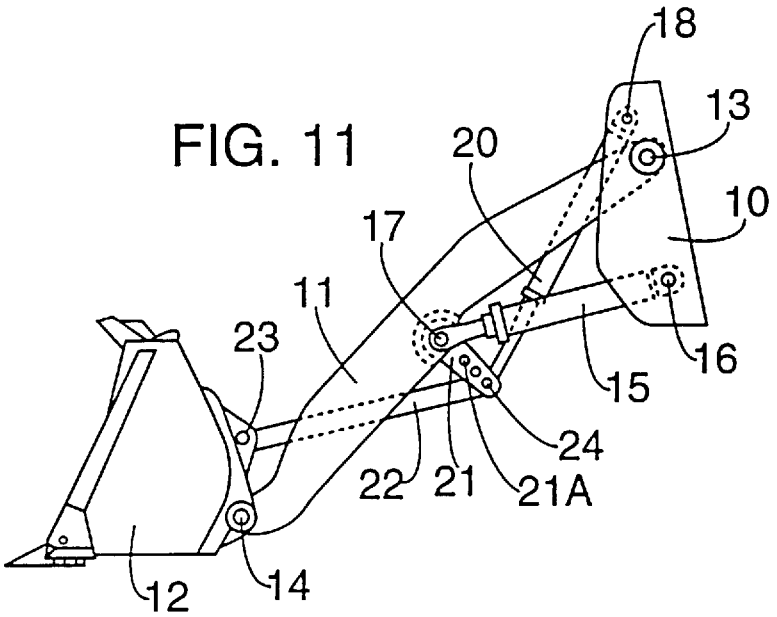
FIG. 11 is a view showing the construction of the working unit of construction equipment with an attachment self leveling linkage in accordance with a still another embodiment of the present invention.
Figure 12:
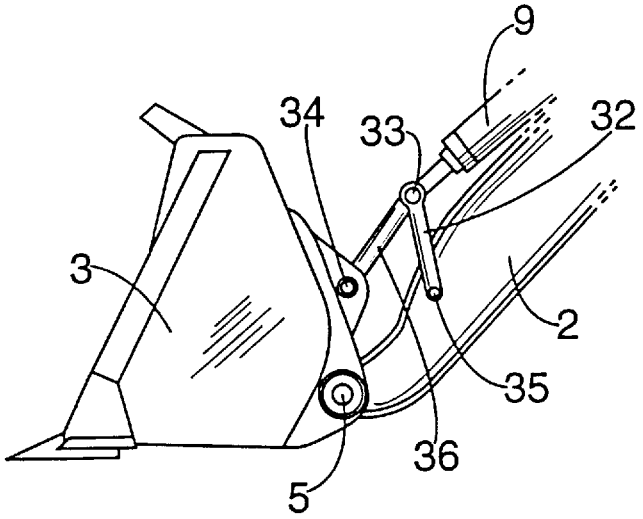
FIG. 12 is a view showing the construction of the working unit of construction equipment with an attachment self leveling linkage in accordance with a still another embodiment of the present invention.
Figure 13:
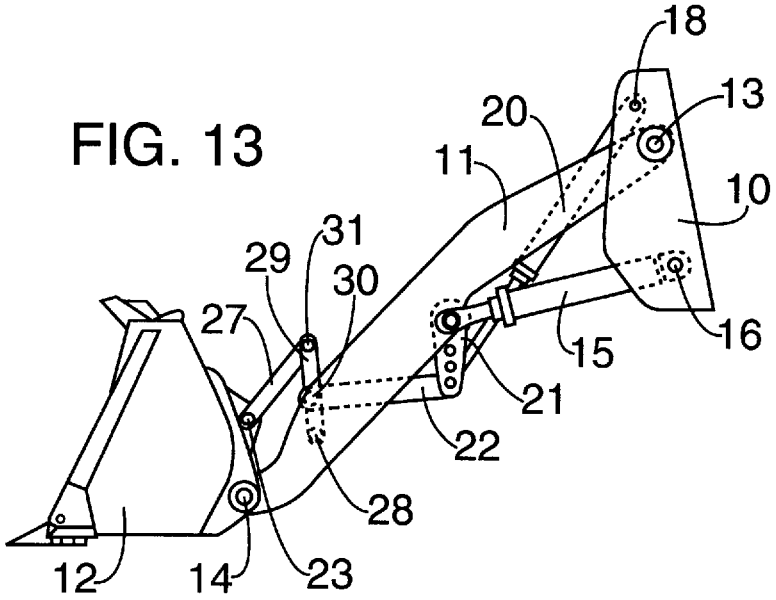
FIG. 13 is a side view of the working unit of a construction equipment with an attachment-self-leveling linkage in accordance with yet another embodiment of the present invention.
Figure 14:
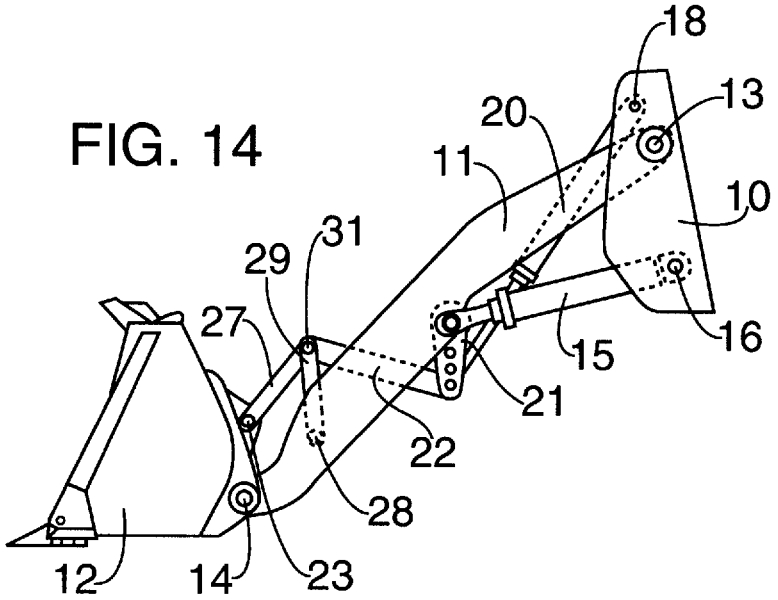
FIG. 14 is a side view of the working unit of a construction equipment with an attachment-self-leveling linkage in accordance with yet another embodiment of the present invention.

The construction of the working unit according to the above fourth embodiment may be preferably altered as shown in FIGS. 10, 11 and 12. The working unit according to the altered embodiment shown in FIG. 10 includes third and fourth links 27 and 29. The third link 27 is pivoted to the bucket 12 by a pivot pin 23 at one end thereof, while the fourth link 29 is pivoted to a predetermined portion of the arm 11 by a pivot pin 28 at one end thereof. The other end of the third link 27 is pivoted to the other end of the fourth link 29 by a pivot pin 31. The above working unit also includes a second link 22 whose one end is pivoted to the pivot joint between the first link 21 and the second telescopic unit 20. The above first link 21 pivotally extends from a predetermined portion of the arm 11, while the above unit 20 pivotally extends from the frame 10. The other end of the second link 22 is not pivoted to the predetermined portion of the bucket 12, but may be pivoted to a predetermined portion of the fourth link 29 by a pivot pin 30. The above fourth link 29 is pivoted to the arm 11 at one end thereof as described above. Alternatively, the other end of the second link 22 may be pivoted to the pivot pin 31 which forms the pivot joint between the third and fourth links 27 and 29.

In order to turn up the arm 11 relative to the frame 10, the arm cylinder 15 is applied with pressurized oil from the oil pump, thereby being extended. When the arm cylinder 15 is extended as described above, the pivot pin 28 is turned about the pivot pin 30 counterclockwise so as to approach the frame 10 in proportion to the extended length of the arm cylinder 15. The above pivot pin 28 pivots the one end of the fourth link 29, which is pivoted to the second link 22 by the pin 30, to the arm 11. Meanwhile, the pivot pin 31 is shifted about the pivot pin 30 counterclockwise so as to become more distant from the frame 10 in accordance with the extending motion of the arm cylinder 15. The above pin 31 pivots the other end of the fourth link 29 to the third link 27.

The above-mentioned positional displacement of the pivot pin 31 causes the one end of the fourth link 29, pivoted to the pivot pin 31, to be pushed leftward in the drawing. Therefore, the bucket 12 pivoted to the other end of the fourth link 29 is turned about the pivot pin 14 counterclockwise. The absolute angle of the bucket 12 is thus controlled, so that the bucket 12 maintains its initial angle relative to the reference or ground surface during the arm-up motion. That is, the bucket 12 maintains its horizontal position relative to the ground surface during the arm-up motion.

In the working unit according to the altered embodiment shown in FIG. 11, one end of the arm 11 is pivoted to the frame 10 by the pivot pin 13 such that the arm 11 is turned about the pivot pin 13. The bucket 12 is pivoted to the other end of the arm 11 by the pivot pin 14. The first link 21 is pivoted to a predetermined portion of the arm 11 by the pivot pin 17 at one end thereof. One end of the second telescopic unit 20 is pivoted to the frame 10 by the pivot pin 18, while the other end of the unit 20 is pivoted to the other end of the first link 21 by the pivot pin 24. The arm cylinder 15 for operating the arm 11 relative to the frame 10 is pivoted to the frame 10 by the pivot pin 16 at one end thereof and pivoted to a predetermined portion of the arm 11 at the other end thereof. Meanwhile, one end of the second link 22 is pivoted to the pivot joint between the unit 20 and the link 21 by the pivot pin 24, while the other end of the link 22 is pivoted to the bucket 12 by the pivot pin 23. The first link 21 is provided with a plurality of hinge holes 21A for selectively changing the position of the pivot joint between the second telescopic unit 20 and the second link 22 relative to said first link 21.

The third and fourth links 27 and 29 may be adapted to all the above-mentioned embodiments of the present invention. That is, the other end of the second link is not directly pivoted to the bucket, but pivoted to a predetermined portion of the fourth link 29. In the above case, one end of the fourth link 29 is pivoted to a predetermined portion of the arm, while the other end of the link 29 is pivoted to the third link 27. The above third link 27 is pivoted to the bucket 12 and to the fourth link 29 at both ends thereof. In addition, the hinge holes 21A of the first link may be adapted to all the above-mentioned embodiments of the present invention.

In the working unit according to the altered embodiment shown in FIG. 12, the other end of the bucket cylinder 9 is pivoted to one end of the third link 36 and to one end of the fourth link 32 by a pivot pin 33. The other end of the third link 36 is pivoted to the bucket 3 by a pivot pin 34. The other end of the fourth link 32 is pivoted to a predetermined portion of the arm by a pivot pin 35. With the above construction, the length of the bucket cylinder 9 of the above working unit is further reduced. Of course, it should be understood that the construction of both the above third and fourth links 36 and 32 may be adapted to all the above-mentioned embodiments of the invention.

In the above embodiments of the invention, it is preferred to set a reference position of the bucket suitable to be easily repeated. For example, it is preferred to maintain the bucket at a position suitable to contain the maximum load during the bucket-up or down motion.

As described above, the present invention provides a working unit of construction equipment with an attachment self leveling linkage. In accordance with the above working unit, the first and second links are shifted in accordance with the telescopic motion of the arm cylinder, thereby maintaining the initial angle or the horizontal position of the bucket relative to the reference or ground surface during the arm-up or down motion. That is, the above working member with the attachment self leveling linkage maintains the horizontal position of the bucket due to the operation of linkage without any motions for controlling the bucket cylinder while the arm cylinder is operated to turn up or down the arm. In accordance with the invention, the desired attachment self leveling function is achieved by a simple link mechanism which is easily produced and installed and reduces the cost. The present invention also reduces the number of the links and pivot joints of the attachment self leveling linkage and shortens the hydraulic cylinders of the working unit, thereby lightening the weight of the working unit and improving the operational efficiency of the working unit.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A working unit of construction equipment comprising an arm pivoted to an equipment's frame and an attachment pivoted to said arm, further comprising an attachment self leveling linkage including:

a first telescopic means pivoted to said frame at one end thereof and pivoted to a predetermined portion of said arm at the other end thereof;

a first link pivoted, at one end thereof, to a pivot joint between the predetermined portion of said arm and the other end of said first telescopic means;

a second telescopic means pivoted to said frame at one end thereof and pivoted to the other end of said first link, the other end of said first link being positioned below said one end of said first link; and a second link pivoted to said attachment at one end thereof and pivoted, at the other end thereof, to another pivot joint between the other end of said second telescopic means and the other end of said first link.

2. A working unit of construction equipment comprising an arm pivoted to an equipment's frame and an attachment pivoted to said arm, further comprising an attachment self leveling linkage including:

a first telescopic means pivoted to said frame at one end thereof and pivoted to a predetermined portion of said arm at the other end thereof;

a first link pivoted, at one end thereof, to a pivot joint between the predetermined portion of said arm and the other end of said first telescopic means;

a second telescopic means pivoted to said frame at one end thereof and pivoted to the other end of said first link, the other end of said first link being positioned below said one end of said first link;

a second link pivoted, at one end thereof, to a pivot joint between the other end of said first link and said second telescopic means and pivoted, at the other end thereof, to a middle portion of an auxiliary link, one end of said auxiliary link being pivoted to a further predetermined portion of said arm; and a third link pivoted to said attachment at one end thereof and pivoted to the other end of said auxiliary link.

3. The working unit according to claim 1, wherein said first link has a hinge hole for selectively changing the position of the pivot joint between the other end of said second telescopic means and the other end of said second link relative to said first link.

4. The working unit according to claim 2, wherein said first link has a hinge hole for selectively changing the position of the pivot joint between the other end of said second telescopic means and the other end of said second link relative to said first link.

5. A working unit of construction equipment having an arm pivoted to an equipment's frame, an attachment pivoted to said arm, and an attachment self leveling linkage, said attachment self leveling linkage comprising:

a first telescopic means pivoted to said frame at one end thereof and pivoted to a predetermined portion of said arm at the other end thereof;

a first link pivoted, at one end thereof, to a Divot joint between the predetermined portion of said arm and the other end of said first telescopic means;

a second telescopic means pivoted to said frame at one end thereof and pivoted to the other end of said first link, the other end of said first link being positioned below said one end of said first link;

a second link pivoted, at one end thereof, to a pivot joint between the other end of said first link and said second telescopic means and pivoted, at the other end thereof, to one end of an auxiliary link, the other end of said auxiliary link being pivoted to a further predetermined portion of said arm; and a third link pivoted to said attachment at one end thereof and pivoted to said one end of said auxiliary link.

* * * * *